US009004658B2

(12) United States Patent
Otsuka et al.

(10) Patent No.: US 9,004,658 B2
(45) Date of Patent: Apr. 14, 2015

(54) LIQUID STORING CONTAINER

(71) Applicant: Seiko Epson Corporation, Tokyo (JP)

(72) Inventors: Nobutoshi Otsuka, Nagano (JP); Taeko Nishimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/183,990

(22) Filed: Feb. 19, 2014

(65) Prior Publication Data

US 2014/0253647 A1 Sep. 11, 2014

(30) Foreign Application Priority Data

Mar. 5, 2013 (JP) ..... 2013-042672

(51) Int. Cl.
*B41J 2/175* (2006.01)
*B41J 29/393* (2006.01)

(52) U.S. Cl.
CPC ..... *B41J 2/17546* (2013.01); *B41J 2/17509* (2013.01)

(58) Field of Classification Search
USPC ..... 347/19, 85, 86, 87
See application file for complete search history.

(56) References Cited

U.S. PATENT DOCUMENTS

| | | | | |
|---|---|---|---|---|
| 6,585,359 | B1 * | 7/2003 | Gasvoda et al. | 347/86 |
| 6,824,258 | B2 * | 11/2004 | Yamamoto et al. | 347/86 |
| 7,168,797 | B2 * | 1/2007 | Arai et al. | 347/86 |
| 7,874,660 | B2 * | 1/2011 | Haines et al. | 347/86 |
| 8,366,252 | B2 * | 2/2013 | Zaba et al. | 347/86 |
| 2004/0165046 | A1 | 8/2004 | Arai et al. | |

FOREIGN PATENT DOCUMENTS

JP 4630551 B2 2/2011

* cited by examiner

*Primary Examiner* — Anh T. N. Vo
(74) *Attorney, Agent, or Firm* — Global IP Counselors, LLP

(57) ABSTRACT

An ink storing container (liquid storing container) includes a memory device configured to store electronic data, an ink containing body (liquid containing body) configured to contain ink, an inner lid configured to cover an ink inlet and outlet formed in the ink containing body, and an outer lid configured to cover the ink inlet and outlet from outside of the inner lid. The memory device is configured to be stored in a storage space formed between the inner lid and the outer lid. Accordingly, without any special additional work to the ink containing body, the memory device can be held by the ink containing body. Also, the memory device is easily removed from the storage space by opening the outer lid.

9 Claims, 3 Drawing Sheets

LIQUID STORING CONTAINER

CROSS-REFERENCE TO RELATED APPLICATIONS

This application claims priority to Japanese Patent Application No. 2013-042672 filed on Mar. 5, 2013. The entire disclosure of Japanese Patent Application No. 2013-042672 is hereby incorporated herein by reference.

BACKGROUND

1. Technical Field

The present invention relates to a liquid storing container having a liquid containing body, which contains liquid such as ink, and a memory medium, which contains electronic data such as an attribute of liquid contained in the liquid containing body.

2. Related Art

The ink used for a printing system, which prints a large poster, etc., is supplied in a state that it is contained in high capacity of an ink container. The ink container is provided with an ink container main body, which contains the ink, and a memory device, which stores attribute data of the ink such as color information, capacity, date of packing, etc. The memory device is readably connected to the printing system when the use of ink is started by the printing system. The attribute data is read in the printing system and is used for the printing control or the residual quantity management.

The ink container is disclosed in Japanese Patent No. 4630551. The ink container in this document is provided with a memory medium placement part, which holds a memory medium on the top surface of the ink container main body. A plurality of ribs are formed in parallel in the memory medium placement part, and the memory medium is mounted and bonded on the top surface of the plurality of ribs. In this document, the bonding area between the memory medium and the ink container main body is reduced by bonding the memory medium on the top of the plurality of ribs, and therefore, the memory medium is easily removed from the ink container main body.

The ink container of Japanese Patent No. 4630551 has a special shape so as to hold the memory medium by the ink container main body. Accordingly, the commonly available liquid containing body, which is distributed in the market, cannot be used as the ink container main body. When the commonly available liquid containing body is used, the additional work is required to form the ribs in the liquid containing body.

SUMMARY

With the consideration of the aforementioned problems, an advantage of some aspects of the invention is to provide a liquid storing container that can detachably hold the memory medium without any special additional work to the commonly available liquid containing body.

For solving the aforementioned problems, a liquid storing container according to an aspect of the invention is provided with a memory medium, which is configured to store electronic data, a liquid containing body, which configured to contain liquid, an inner lid, which is configured to cover an opening formed in the liquid containing body, and an outer lid, which is configured to cover the opening from the outside of the inner lid. The memory medium is configured to be stored in the storage space formed between the inner lid and the outer lid.

According to the aspect of the invention, the lid body to open and close the opening of the liquid containing body is configured by the inner lid and the outer lid, and the memory medium is supported in the storage space formed between these inner lid and outer lid. Accordingly, the liquid storing container can hold the memory medium without any special additional work to the liquid containing body. Also, the memory medium can be easily taken out (removed) from the storage space by opening the outer lid.

In another aspect of the invention, the outer lid is preferable to be provided with a transparent part. Because of this, it is easy to recognize whether or not the memory medium is supported in the storage space. Accordingly, it can prevent forgetting to store the memory medium to the storage space or it can prevent forgetting to remove the memory medium from the storage space.

In this case, it has a storage bag configured to store the memory medium. The memory medium is stored in the storage space in the state of being stored in the storage bag so that the color of the storage bag and the color of the inner lid can be different with respect to each other. In this way, the visibility of the storage bag is improved so that it is easy to recognize the existence of the memory medium. Accordingly, it can prevent forgetting to store the memory medium to the storage space or it can prevent forgetting to remove the memory medium from the storage space.

In this case, the color of the inner lid and the color of the liquid containing body can be different. In this way, it is easy to recognize the existence of the inner lid so that it is easy to recognize the memory device mounted on the inner lid. Accordingly, it can suppress and prevent forgetting to store the memory medium in the storage space between the inner lid and the outer lid, or to prevent forgetting to remove the memory medium from the storage space between the inner lid and the outer lid.

In this case, it has a storage bag configured to store the memory medium. The memory medium is stored in the storage space in the state that it is stored in the storage bag so that the color of the storage bag and the color of the liquid storing container can be different. In this way, the visibility of the storage bag is improved so that it is easy to recognize the existence of the memory medium. Accordingly, it can prevent forgetting to store the memory medium to the storage space or it can prevent forgetting to remove the memory medium from the storage space.

In this case, the color of the storage bag can be different from the color of the liquid. In this way, it can easily recognize the memory medium even when the liquid is adhered to the liquid containing body or the inner lid.

In another aspect of the invention, the storage bag has flexibility, and a planer shape of the storage bag in a flat condition has wider area than the opening. In this way, it can prevent or suppress the memory medium, which is in the state of being stored in the storage bag, from falling down into the liquid containing body through the opening.

In another aspect of the invention, the memory medium is provided with a circuit board, and the color of the circuit board can be different from the color of the liquid. In this way, it can easily recognize the existence of the memory medium even when the liquid is adhered to the liquid containing body or the inner lid.

In another aspect of the invention, it has a holder configured to hold the memory medium, and the memory medium is stored in the storage space in the state that it is held by the holder, and the opening is a central hole of a tubular part provided in the liquid containing body, and the outer lid covers the opening in the mounting state in which the outer lid only covers a predetermined length dimension of the tubular part from the distal end side of the tubular part, and in the state that a plurality of holders are stored in the storage space, it is preferable that the inner lid is unable to be in the mounting state. In this way, it can be prevented from erroneously storing the plurality of memory mediums in the storage space.

In the liquid storing container according to the aspect of the invention, the memory medium is stored in the storage space between the inner lid and the outer lid. Accordingly, the memory medium can be detachably supported by using the liquid containing body distributed in the market. Also, it can easily remove the memory medium from the storage space by opening the outer lid.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, the ink storing container in which the present invention is applied will be described in reference to the drawings.

Overall Structure

Figure 1:
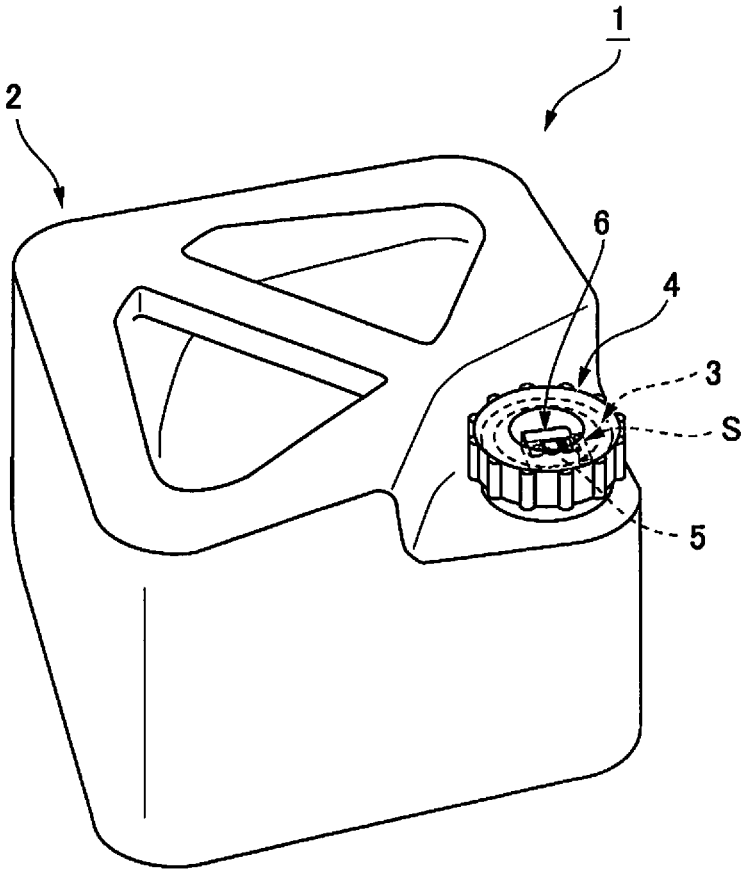
FIG. 1 is a perspective view of an ink storing container in which the present invention is applied.

FIG. 1 is a perspective view showing the external appearance of the ink storing container in which the present invention is applied. An ink storing container (liquid storing container) 1 is used for retaining the ink supplied to a printing system, which prints a large poster, etc., and is used for conveying.

The ink storing container 1 is provided with an ink containing body (liquid containing body) 2, which contains the ink, an inner lid 3, which covers an ink inlet and outlet (opening) 2*a* of the ink containing body 2, an outer lid 4, which covers the ink inlet and outlet 2*a* from the outside of the inner lid, and a memory device packaging body 6 in which a memory device (memory medium) 5 is packed. The memory device 5 contains the attribute data (electronic data) such as ink color information, capacity, date of packing, etc. in the ink containing body 2. When the use of ink is started by the printing system, the memory device 5 is readably connected to the printing system. Also, the attribute data read from the memory device 5 to the printing system is used for the printing control or the residual quantity management. The memory device packaging body 6 is stored in a storage space S provided between the inner lid 3 and the outer lid 4.

The ink storing container 1 is a rectangular shape as a whole, and when a plurality of ink storing containers 1 are conveyed, it is possible to arrange it in the forward and backward direction and the left and right direction by closely attaching the side surfaces of the respective ink storing containers 1 each other on the conveyance pallet.

Ink Containing Body

Figure 2:
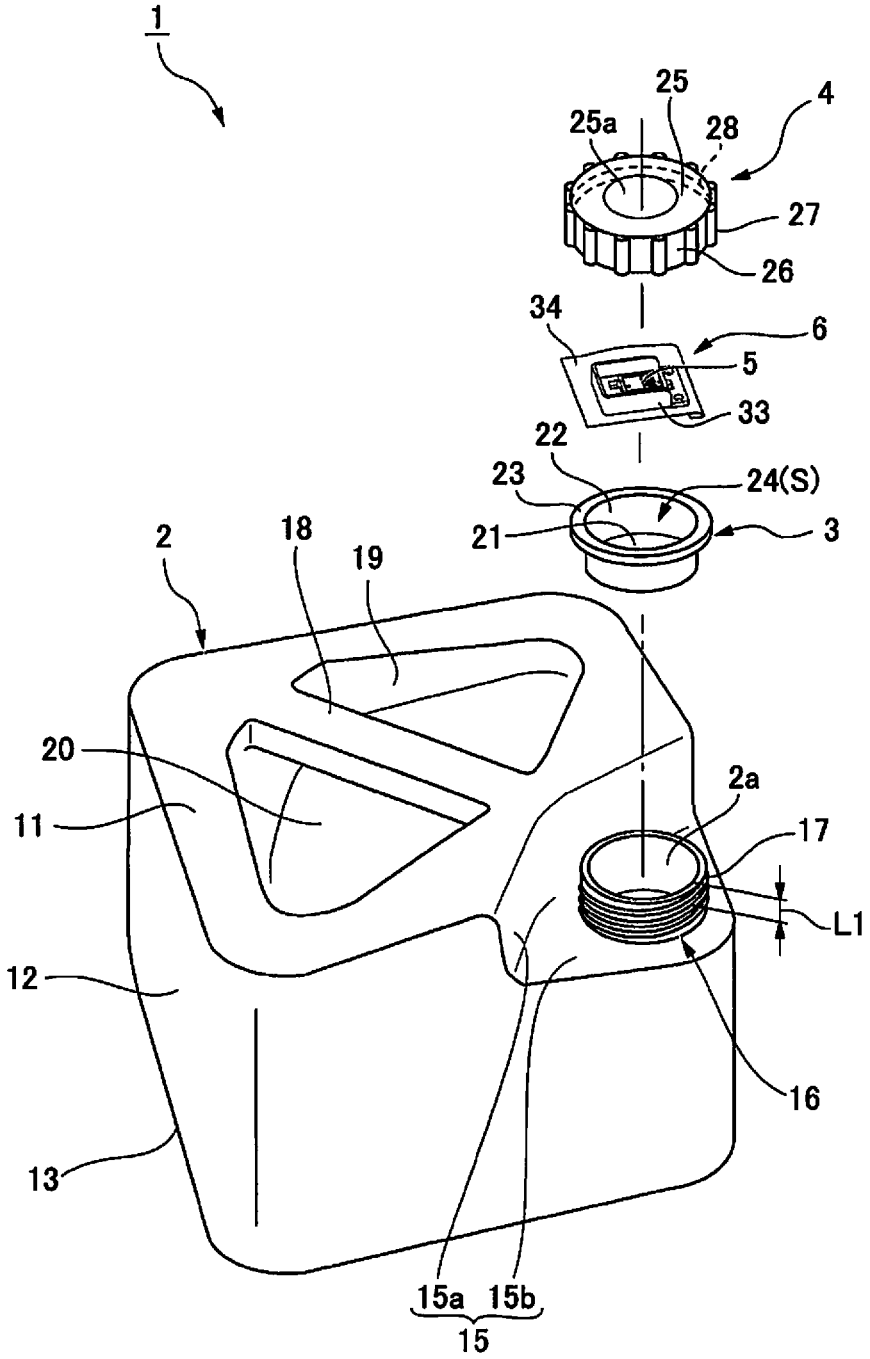
FIG. 2 is an exploded perspective view of the ink storing container.

FIG. 2 is an exploded perspective view of the ink storing container 1. The ink containing body 2 is made of resin, and it is provided with an upper surface part 11, a body part 12, which is a square cylindrical shape extending downward from the outer peripheral edge of the upper surface part 11, and a bottom surface part 13, which blocks lower end of the body part 12. The planar shape viewed from the upside of the ink storing container 1 is a square shape, and the four corners are rounded.

In the edge part of one corner of the upper surface part 11, a step part 15 recessed downward is formed. The step part 15, which is notched from above and sides, is formed, and it is provided with a side surface 15*a* toward the outer peripheral side and a bottom surface 15*b* toward the upper side. In the bottom surface 15*b*, a cylindrical part (tubular part) 16 which protrudes to the upside is provided. The central hole of the cylindrical part 16 is the ink inlet and outlet 2*a* which is communicated to the inner part of the ink containing body 2. A male screw is formed in the outer peripheral surface of the cylindrical part 16.

Further, in the upper surface part 11, a bar-shaped gripping part 18, which extends along the diagonal line from the corner where the ink inlet and outlet 2*a* is formed, is provided. Concave parts 19 and 20 are formed in both sides of the gripping part 18 sandwiching the diagonal line, and these concave parts 19 and 20 are communicated in the lower side of the gripping part 18.

Here, the ink containing body 2 is white color, but when the ink is stored in the ink containing body 2, the hue of the ink can be determined from the external appearance. For example, when a magenta ink is stored in the ink containing body 2, the external appearance of the ink containing body 2 becomes pale-purplish-red, and therefore, the hue of the ink can be determined.

Inner Lid and Outer Lid

The inner lid 3 is made of resin, and it is provided with a circular-shaped lid plate 21, an inner lid cylindrical part 22, which extends to the upside from the outer peripheral edge of the lid plate 21, and an annular flange 23, which is expanded outward in a radial direction from the upper edge of the inner lid cylindrical part 22. A concave part 24 is formed in the inner lid 3 by the lid plate 21 and the inner lid cylindrical part 22. The lid plate 21 and the inner lid cylindrical part 22 are inserted in the inner circumference side of the cylindrical part 16 of the ink containing body 2, and in the state that the lower surface of the flange 23 and the upper edge surface of the cylindrical part 16 are contacted, the inner lid 3 covers the cylindrical part 16 so as to cover the ink inlet and outlet 2*a*. The outer diameter dimension of the inner lid cylindrical part 22 of the inner lid 3 is substantively the same dimension as the inner diameter dimension of the cylindrical part 16 of the ink containing body 2, and in the state that the inner lid 3 covers the cylindrical part 16, the outer circumferential surface of the inner lid cylindrical part 22 and the inner circumferential surface of the cylindrical part 16 are closely contacted. By the way, the outer diameter dimension of the flange 23 is less than or equal to the outer diameter dimension of the cylindrical part 16, and the flange 23 does not protrude outward from the annular upper end surface of the cylindrical part 16. Here, the coloring is applied to the inner lid 3. In the present example, the color of the inner lid 3 is magenta which is the same color as the ink.

The outer lid 4 covers the ink inlet and outlet 2*a* from the outside of the inner lid 3. The outer lid 4 is made of resin, and it is provided with a disk-shaped lid plate 25 and an outer lid cylindrical part 26 which extends downward from the outer peripheral edge of the lid plate 25. In the outer circumferential surface of the outer lid cylindrical part 26, a plurality of ribs 27, which extends vertically, is formed in an equal angle interval. In the inner circumferential surface of the outer lid cylindrical part 26, a female screw 28 capable of being screwed to the male screw 17 formed in the outer circumferential surface of the cylindrical part 16 of the ink containing body 2 is formed. In the state that the entire female screw 28 of the outer lid 4 is screwed to the male screw 17 of the cylindrical part 16 of the ink containing body 2 and the outer lid 4 is fastened to the cylindrical part 16, it becomes the mounting state that the outer lid 4 only covers a predetermined length dimension L1 from the upper edge side (distal end side) of the cylindrical part 16 so that as shown in FIG. 1, a small space is formed between the outer lid 4 and the bottom surface 15*b* of the step part 15 of the ink containing body 2. Here, in the present example, a circular-shaped transparent part 25*a* is provided in the middle of the lid plate 25. The outer lid 4 is white color entirely except the transparent part 25*a*.

Memory Device Packaging Body

Figure 3A:
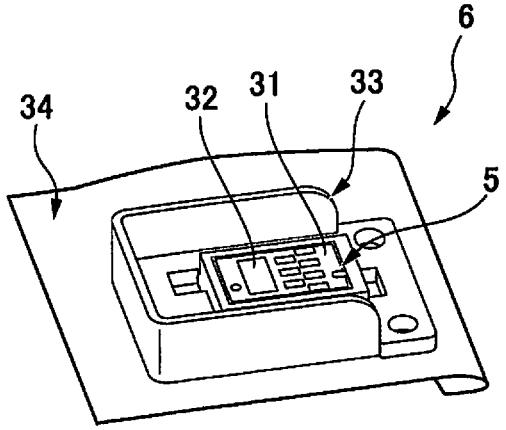
FIG. 3A is a perspective view of a memory device packaging body and a holder in which a memory device is mounted.
Figure 3B:
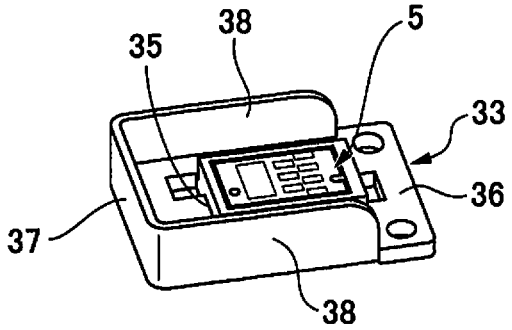
FIG. 3B is the perspective view of the memory device packaging body and the holder in which the memory device is mounted.

FIG. 3(*a*) is a perspective view of a memory device packaging body 6, and FIG. 3(*b*) is a perspective view of a holder 33 in which a memory device 5 is mounted. As shown in FIG. 3(*a*), the memory device packaging body 6 is that a circuit board 31 and the memory device 5 provided with a memory IC 32 mounted on the circuit board 31 are mounted and stored in a translucent storage bag 34. The color of the circuit board 31 is green.

The holder 33 is made of resin, and the color is white. The holder 33 is provided with a rectangular-shaped bottom plate 36 having a holding part 35 in which the memory device 5 is held in the middle, a first side plate 37 extending along the edge of one of the short sides of the bottom plate 36 with constant height, a pair of second side plates 38 extending from the left and right edges of the first side plate and extending along the edge part of the long sides of the bottom plate 36. The first side plate 37 and the pair of second side plates 38 continuously extend from the bottom plate 36 and extend toward a portion intersecting with the bottom plate 36. The pair of second side plates 38 extends from one edge of the long side of the bottom plate 36 to the halfway of the long side. The memory device 5 which is held by the holding part 35 is surrounded from three directions by the first side plate 37 and the pair of second side plates 38.

The storage bag 34 is made of polyethylene and the color is blue. The planar shape of the storage bag 34 in a flat condition is rectangle, and it has a wider area than the opening area of the ink inlet and outlet 2*a*. By the way, as the storage bag 34, it is obvious that a flexible bag formed by a film that the electrostatic countermeasure has been applied may be used.

Here, only one memory device packaging body 6 (holder 33) can be arranged inside of the concave part 24 formed in the inner lid 3. That is, when the memory device packaging body 6 is arranged inside of the concave part 24 in a state of being the bottom plate 36 vertical, it becomes in a state that a part of the memory device packaging body 6 is projected upward from the concave part 24. Further, when two memory device packaging bodies 6 are arranged in the concave part 24 in a state of being the bottom plate 36 downward, a part of the memory device packaging bodies 6 are overlapped each other so that it becomes in the state that the part of the memory device packaging body, which is mounted on the upper side, is projected upward from the concave part 24.

Storing into Storage Space of Memory Device

The holding procedure that the memory device packaging body 6 is supported by the ink containing body 2, the inner lid 3, and the outer lid 4 will be described in reference to FIGS. 1 to 3. When the memory device packaging body 6 is supported by the ink containing body 2, the inner lid 3, and the outer lid 4, first, the memory device 5 provided with the green color circuit board is mounted on the white color holder 33. And, the memory device packaging body 6 is configured by storing the holder 33, in which the memory device 5 is mounted, into the blue color storage bag 34. Further, the ink inlet and outlet 2*a* is blocked by mounting the magenta inner lid 3 in the cylindrical part 16 of the ink containing body 2 in which the ink is stored. Here, in the present example, the ink of magenta is stored in the ink containing body 2.

Next, the memory device packaging body 6 is arranged in the concave part 24 formed by the lid plate 21 of the inner lid 3 and the cylindrical part 16. And, it is covered by the outer lid 4 from the upside of the cylindrical part 16, and the outer lid 4 and the cylindrical part 16 are screwed so that the outer lid 4 is fastened to the ink containing body 2. Because of this, it becomes in a state that the lid plate 25 of the outer lid 4 and the flange 23 of the inner lid 3 are contacted, and the storage space S (see FIG. 1) is formed by the concave part 24 of the inner lid 3 and the lid plate 25 of the outer lid 4 between the inner lid 3 and the outer lid 4. Further, the memory device packaging body 6 is supported and stored in the storage space S. In the state that the outer lid 4 is fastened in the ink containing body 2, it becomes in the mounting state that the outer lid 4 only covers a predetermined length dimension L1 from the upper edge side (distal end side) of the cylindrical part 16 so that a small space is formed between the outer lid 4 and the bottom surface 15*b* of the step part 15.

Here, when two memory device packaging bodies 6 are erroneously arranged in the concave part 24 formed by the lid plate 21 of the inner lid 3 and the cylindrical part 16, the memory device packaging bodies 6 are overlapped each other so that it becomes in the state that the part of the memory device packaging body 6, which is mounted on the upper side, is projected upward from the concave part 24. Therefore, when the outer lid 4 is fastened to the ink containing body 2 by screwing the outer lid 4 to the cylindrical part 16, the memory device packaging body 6, which is mounted on the upper side, and the lid plate 25 of the outer lid 4 are interfered. As a result, it cannot be in the mounting state that the outer lid 4 only covers the predetermined length dimension L1 from the upper edge side (distal end side) of the cylindrical part 16. Therefore, it prevents that a plurality of memory device packaging bodies 6 are erroneously stored in the storage space S.

Function Effect

According to the present example, the lid body, which opens and closes the ink inlet and outlet 2*a* of the ink containing body 2, is configured by the inner lid 3 and the outer lid 4, and the memory device 5 is supported in the storage space S formed between these inner lid 3 and the outer lid 4. Accordingly, without any special additional work to the ink containing body 2, the memory device 5 can be supported in the ink containing body 2. Also, the memory device 5 can be easily taken out from the storage space S by opening the outer lid 4.

Further, in the present example, the outer lid 4 is provided with the transparent part 25*a* so that it is possible to recognize whether or not the memory device 5 is supported in the storage space S. Accordingly, it can prevent forgetting to store the memory device 5 to the storage space S or it can prevent forgetting to remove the memory device 5 from the storage space S.

Next, in the present example, the color of the inner lid 3 (magenta) and the color of the ink containing body 2 (white) are different. Accordingly, it is easy to recognize the existence of the inner lid 3, and it is easy to recognize the memory device packaging body 6 mounted on the inner lid 3. Also, in the present example, the color of the storage bag 34 (blue color) and the color of the ink containing body 2 (white) are different, and the color of the storage bag 34 (blue color) and the color of the inner lid 3 (magenta) are also different. Because of this, the visibility of the storage bag 34 is improved so that it is easy to recognize the existence of the memory device packaging body 6. Therefore, it can prevent forgetting to store the memory device 5 to the storage space S or it can prevent forgetting to remove the memory device 5 from the storage space S.

Further, in the present example, the color of the storage bag 34 (blue color) and the color of the ink (magenta) are different, and the color of the circuit board 31 of the memory device 5 (green color) and the color of the ink (magenta) are different. Accordingly, even when the ink is adhered to the ink containing body 2 or the inner lid 3, etc., the memory medium can be easily recognized.

Also, in the present example, the planar shape of the storage bag 34 in the flat condition has wider area than the ink inlet and outlet 2*a* so that it can prevent or suppress the memory device packaging body 6 from falling down into the ink containing body 2 through the ink inlet and outlet 2*a*.

Further, in the present example, when a plurality of memory device packaging bodies 6 are stored in the storage space S, the outer lid 4 is unable to be in the mounting state and only covers a predetermined length dimension from the upper edge side of the cylinder part 16. Accordingly, it can be prevented from erroneously storing the plurality of memory devices 5 in the storage space S.

Modified Example

The respective colors of the ink containing body 2, the inner lid 3, the outer lid 4, the storage bag 34, the circuit board 31, and the ink stored in the ink containing body 2 are an example so that it is not limited to the aforementioned combination. Also, the aforementioned example is an example of the liquid storing container that stores the ink as liquid, but the stored liquid is not limited to the ink. By the way, in the aforementioned example, the memory device contains attribute data related to the stored liquid, but the information contained in the memory device is not limited to the information. Further, as the memory device, a memory card may be employed.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid storing container comprising:

a memory medium configured to store electronic data;

a liquid containing body configured to contain liquid;

an inner lid configured to block an opening which serves as a liquid inlet and outlet opening formed in the liquid containing body so as to contain the liquid; and an outer lid configured to cover the opening from outside of the inner lid;

the memory medium being configured to be stored in a storage space formed between the inner lid and the outer lid.

2. The liquid storing container according to claim 1, wherein the outer lid has a transparent part.

3. The liquid storing container according to claim 1, further comprising a storage bag configured to store the memory medium, wherein the memory medium is stored in the storage space in a state of being stored in the storage bag, and a color of the storage bag and a color of the inner lid are different with respect to each other.

4. The liquid storing container according to claim 1, wherein a color of the inner lid and a color of the liquid containing body are different.

5. The liquid storing container according to claim 1, further comprising a storage bag configured to store the memory medium;

wherein the memory medium is stored in the storage space in a state of being stored in the storage bag, and a color of the storage bag and a color of the liquid containing body are different.

6. The liquid storing container according to claim 3, wherein a color of the storage bag is different from a color of the liquid.

7. The liquid storing container according to claim 3, wherein the storage bag has flexibility, and a planer shape of the storage bag in a flat condition has wider area than the opening.

8. The liquid storing container according to claim 1, wherein the memory medium has a circuit board, and a color of the circuit board is different from a color of liquid.

9. The liquid storing container according to claim 1, further comprising a holder configured to hold the memory medium, wherein the memory medium is stored in the storage space in a state of being held by the holder, the opening is a central hole of a tubular part provided in the liquid containing body, the outer lid covers the opening in a mounting state in which the outer lid only covers a predetermined length dimension of the tubular part from a distal end side of the tubular part, and the outer lid is unable to be in the mounting state in a state that a plurality of the holders are stored in the storage space.

* * * * *